US007361083B2

(12) United States Patent
Valero Moreno

(10) Patent No.: US 7,361,083 B2
(45) Date of Patent: Apr. 22, 2008

(54) MULTIMEDIA SYSTEM AND METHOD FOR REMOTE MONITORING OR REFEREEING IN DART MACHINES

(75) Inventor: Javier Valero Moreno, Barcelona (ES)

(73) Assignee: Gaelco, S.A., Barcelona (ES)

( * ) Notice: Subject to any disclaimer, the term of this patent is extended or adjusted under 35 U.S.C. 154(b) by 859 days.

(21) Appl. No.: 10/609,394

(22) Filed: Jul. 1, 2003

(65) Prior Publication Data

US 2005/0075153 A1 Apr. 7, 2005

(51) Int. Cl.
*A63F 9/24* (2006.01)

(52) U.S. Cl. ..... 463/1; 463/42; 473/476; 273/371; 273/372; 273/373

(58) Field of Classification Search ..... None
See application file for complete search history.

(56) References Cited

U.S. PATENT DOCUMENTS 4,131,948 A * 12/1978 Kaenel ..... 700/92
4,302,010 A * 11/1981 Kaenel ..... 473/70
4,531,187 A 7/1985 Uhland
4,567,461 A * 1/1986 Honekman et al. ..... 340/323 R
4,593,904 A 6/1986 Graves
4,824,121 A * 4/1989 Beall et al. ..... 273/376
4,910,677 A * 3/1990 Remedio et al. ..... 700/92
5,018,736 A 5/1991 Pearson et al.
5,083,271 A 1/1992 Thacher et al.
5,083,800 A 1/1992 Lockton
5,114,155 A * 5/1992 Tillery et al. ..... 273/371
5,294,912 A * 3/1994 Bednarz et al. ..... 340/323 R
5,359,510 A 10/1994 Sabaliauskas
5,413,345 A * 5/1995 Nauck ..... 473/156
5,489,886 A * 2/1996 Wexler et al. ..... 340/323 R
5,593,349 A * 1/1997 Miguel et al. ..... 463/30
5,626,523 A * 5/1997 Mowers et al. ..... 473/58
5,683,080 A * 11/1997 Vaioli et al. ..... 473/69
5,857,912 A * 1/1999 Freitag et al. ..... 463/42
5,971,397 A * 10/1999 Miguel et al. ..... 273/371
6,076,021 A * 6/2000 Houriet et al. ..... 700/93
6,149,529 A * 11/2000 Fowler et al. ..... 472/89
6,371,860 B1 * 4/2002 Anderson ..... 473/1
7,005,970 B2 * 2/2006 Hodsdon et al. ..... 340/323 R
2002/0122115 A1 * 9/2002 Harmath ..... 348/157
2003/0096645 A1 * 5/2003 Soltys et al. ..... 463/25
2003/0134700 A1 * 7/2003 Salva ..... 473/476

FOREIGN PATENT DOCUMENTS

DE 4314145 A1 11/1994
DE 19539837 A1 * 4/1997

(Continued)

*Primary Examiner*—John M. Hotaling, II
*Assistant Examiner*—Tramar Harper
(74) *Attorney, Agent, or Firm*—Hunton & Williams LLP

(57) ABSTRACT

A system and method which comprises a plurality of amusement machines (i.e., video games, flipper games, pinball machines, prize dispensing games, arcade games, electronic darts, kiddie rides, pool tables, golf games, basketball games, billiards, redemption games, soccer tables, shuffle board alleys and bowling alleys, touch-screen countertop games and the like) equipped with play components and associated apparatus to capture multimedia information based on the performance of the players at the machines, apparatus to transmit the multimedia information captured from the machines to a network, and a processor based machine (e.g., a central processing unit (CPU)) for managing and storing this multimedia information.

19 Claims, 4 Drawing Sheets

FOREIGN PATENT DOCUMENTS

| | | | |
|---|---|---|---|
| EP | 0697579 | A1 | 10/1994 |
| EP | 0752089 | B1 | 4/1995 |
| EP | 697579 | A1 * | 2/1996 |
| GB | 2 185 896 | A | 8/1987 |
| GB | 2 214 436 | A | 9/1989 |

* cited by examiner

MULTIMEDIA SYSTEM AND METHOD FOR REMOTE MONITORING OR REFEREEING IN DART MACHINES

BACKGROUND OF THE INVENTION

1. Field of the Invention

This invention is related to the field of coin operated (coin-op) amusement machines. In particular, the invention relates to a system and method which comprises a plurality of amusement machines (i.e., video games, flipper games, pinball machines, prize dispensing games, arcade games, electronic darts, kiddie rides, pool tables, golf games, basketball games, billiards, redemption games, soccer tables, shuffle board alleys and bowling alleys, touch-screen countertop games and the like) equipped with play components and associated means to capture multimedia information based on the performance of the players at the machines, means to transmit the multimedia information captured from the machines to a network, and a processor based machine (e.g., a central processing unit (CPU)) for managing and storing this multimedia information.

2. Description of the Prior Art

A good number of coin-op amusement machines with means to capture data on the games and players and of connecting to a network, such as a LAN or a WAN (e.g., the Internet), are currently known.

For example, European Patent EP 697,579, to Bozkaya, discloses a dart board with means to display the result of a darts game. The board is equipped with an instant camera, which permits immediately determination the winner of a game, as a photograph is taken when the dartboard is hit or a determined score is reached and displays the photograph of the winning player.

German Patent DE-A-43 14 145 discloses a system for playing in several dart game amusement machines. In particular, the system includes slot machines, remotely installed in relation to one another, with at least two game machines installed in different places, with a bidirectional connecting line between the game machines, different disks subdivided in sectors to receive the darts, a device to record and indicate the position of the impacts on the disk and a computer to process, evaluate and transmit the data.

European Patent EP 752,089, of NSM AG, discloses a similar system, wherein a number of transmitter and receiver components, rigidly arranged outside the disk, whose connecting lines form a grid and are interlaced by a dart that hits the disk, coordinates being assigned to the grids. The values of the co-ordinates where the dart impacts are transmitted to other machines via modem and a data telecommunication line. The system is provided with a computer connected by the line to process, evaluate and transmit the data and a screen to display the results.

U.S. Pat. No. 5,593,349 to Miguel et al., discloses a league and tournament system which includes a centralized league machine which transmits data to one or more of a plurality of darts machines via modem or using the wireless portable data storage device. The information from the electronic darts machines can be transmitted via MODEM, by facsimile transmission or using the portable data storage device. The darts machines are configured to receive and use the information from the database on the league and tournament for a variety of purposes, including the automatic implementation of player handicaps, the automatic control of play, and recording the team and player who are using the dart machine. The machine has a monitor which displays context sensitive menus using information from the data base.

In the art there, therefore, exists the possibility that players may play games or participate in leagues in different locations, connected to one another and to a computer by telecommunications lines. In particular, the Internet or other computer network may be used to communicate, and the data and results from the games may be recorded in a computer and transmitted to the machines.

Furthermore, in the sub set of amusement machines known as video games, it is typically the system that imposes and enforces the rules. For example, video game systems are typically closed, and there is little possibility of cheating, as the system software prevents it because the entire game is played on the machine in a controlled, closed loop.

On the contrary, in amusement machines that comprise games or sports machines, such as darts, snooker, golf, basketball machines, etc., part of the action is performed independent of the machine. In these scenarios, the system is incapable of detecting all possible infringements of the game rules and regulations or possible cheating by the players outside the system control capabilities. For this and other types of amusement machines, the current systems and methods do not provide optimal systems and methods for controlling and discerning the validity of the play, or if play and players abide by the rules. This is a practical drawback when one wants to carry out global competitions in different parts of the planet. Other drawbacks also exist.

DESCRIPTION OF THE INVENTION

An object of the present invention is to provide a management system and method for amusement machines, located either in substantially the same location or at a remote location with respect to one another. The system and method is applicable to any type of amusement machines, whether sports machines (e.g., darts, etc.) or otherwise.

Another object the invention is to provide a method to manage the refereeing of the games played on amusement machines wherein a human or non-human referee can make decisions at a remote site. Monitoring or Refereeing may occur in real time or with a time delay, based, at least in part, on multimedia information captured from the amusement machines which may communicate over a network such as the Internet. Accordingly, the system and method enables game play to be monitored and refereed, cheating to be reduced and enhances fair competition in games and between players.

These and other objects may be achieved by providing a system and method comprising amusement machines that further comprise multimedia information and data capturing means. For example, multimedia information capturing means may comprise imaging devices (e.g., digital or analog cameras or video recorders), auditory recording devices (e.g., digital or analog sound recorders) and other devices that capture the images and sounds of the players and the play as it develops during a game. Other data capturing devices, such as score boards, impact sensors (e.g., for darts, shooting or golf games), distance measuring devices, or other appropriate sensors as dictated by the particular requirements of the game or sport to be played.

The system and method further provides with one or more monitoring or refereeing centers. The monitoring or refereeing centers may receive the multimedia information and other data from the amusement machines. The multimedia information and other data may be transmitted over a network (e.g., a LAN, WAN, the Internet, a wireless network, a cellular network, etc.) to an appropriate receiving device (e.g., monitors, computers, speakers, etc.) at the refereeing center. The refereeing center may be located anywhere that is accessible via the network including remote locations. Monitoring or refereeing may occur either substantially instantaneously (e.g., in real time) or at a later time (e.g., with a time delay).

The system and method also comprises implementing computer-assisted refereeing means. For example, a luminous source of visible light (e.g., a laser, or other visible light beam) may be used to project lines, boundaries, or other limits of the area of play (e.g., a place where the player is to stand, or the like). Other computer assisted sensors (e.g., speed monitoring devices), out-of-bounds sensors (e.g., pressure transducers or the like) and the multimedia information capturing devices may be input into a computer or other processor-based device (e.g., laptop, personal digital assistant (PDA), special purpose monitoring station, or the like) in order to assist an evaluation of whether game play or player conduct conforms to the rules of the particular game.

The monitoring or refereeing centers may be a "call center" for a game promoter and conveniently comprise monitors to monitor the state of development of the games on the amusement machines from the data located on the network. In addition, information from the amusement machines may be stored or otherwise archived at the monitoring or refereeing centers.

The refereeing center and the amusement machines may also comprise a multimedia telecommunications system. For example, microphones, speakers, video monitors and cameras may be incorporated into the amusement machines and the refereeing centers. With the telecommunication system, the referee can observe the entire game environment and all the incidents that may arise during each game. The refereeing decisions can be made known at any point of play and be appealed, interactively, between players and the refereeing centers.

In some embodiments, the refereeing center may comprise an optical surveillance system, incorporated in each machine, and a local (LAN) or wide area (WAN) network telecommunication system. In addition, a surveillance system in each machine comprise a video camera or cameras, with filters, reflective elements and electronic equipment, which simultaneously capture images from different sources, with varied, changing lighting.

In some embodiments, the refereeing center or amusement machine may incorporate auxiliary electronic elements that automatically detect situations of play that contravene the rules or regulations of play applicable in each case. For example, auxiliary electronic devices may vary depending on whether the amusement machines are darts, snooker, golf machines, etc., thus, facilitating the referee's job. For example, these elements may perform a function similar to that of the ball detectors used in modern tennis courts to indicate whether a serve has entered in the regulatory area or not.

The remote refereeing system and method may be assisted by a computer system that permits selectively storing sequences of images that record the complete development of the games, so that the referee can determine, at any time, if the players have respected the rules of play or if, on the contrary, they have committed infringements.

The information can be transmitted by a local computer network or by Internet, via cable, wire, satellite or wireless mechanisms. In any case, a dedicated computer program permits analyzing and managing the multimedia data from the machines, as well as transmitting multimedia data thereto. The referee's decisions are included in this multimedia data.

The telecommunication system permits establishing an interactive multimedia conferencing between the players and the referee. For example, a conference may be conducted if a player wishes to contest a referee's decision.

As will be appreciated by those skilled in the art, the system of this invention permits playing individual or team competitions on a global scale, wherein the games are played with efficient supervision of all incidents of play, as it includes the game environment in the system.

BRIEF DESCRIPTION OF THE DRAWINGS

The invention is explained in detail further on and by way of non-restrictive example, referring to the accompanying drawings in which.

DETAILED DESCRIPTION OF THE INVENTION

Figure 1:
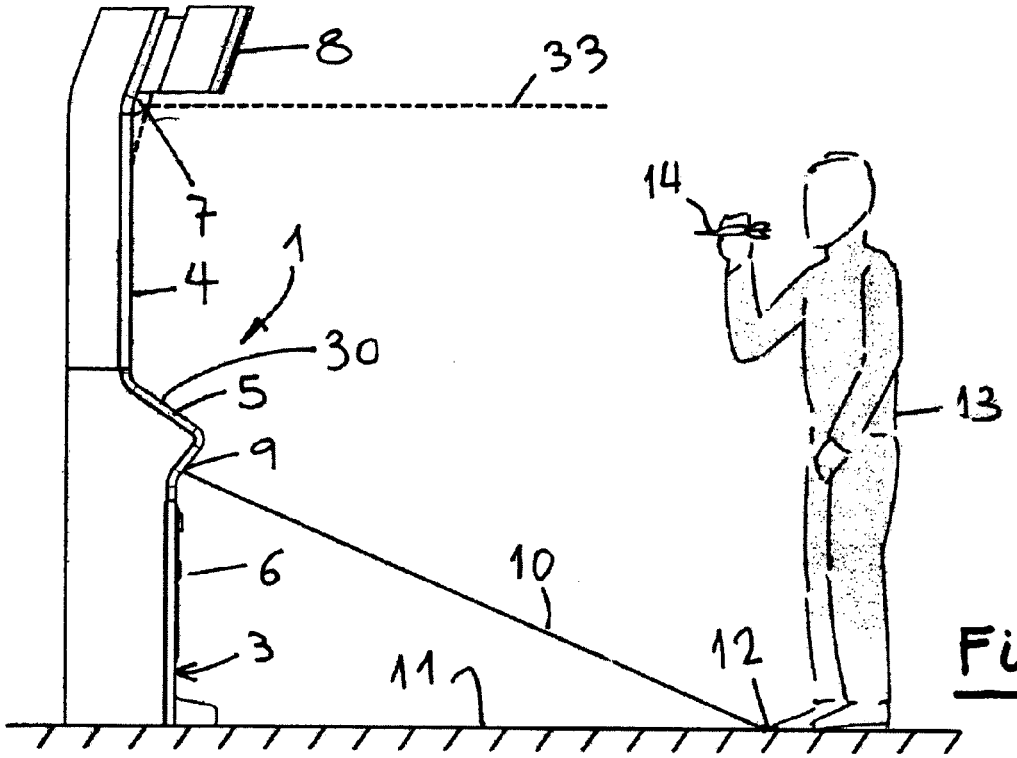
FIG. 1 illustrates a side elevational view of a darts machine and the area of play according to the present invention.
Figure 2:
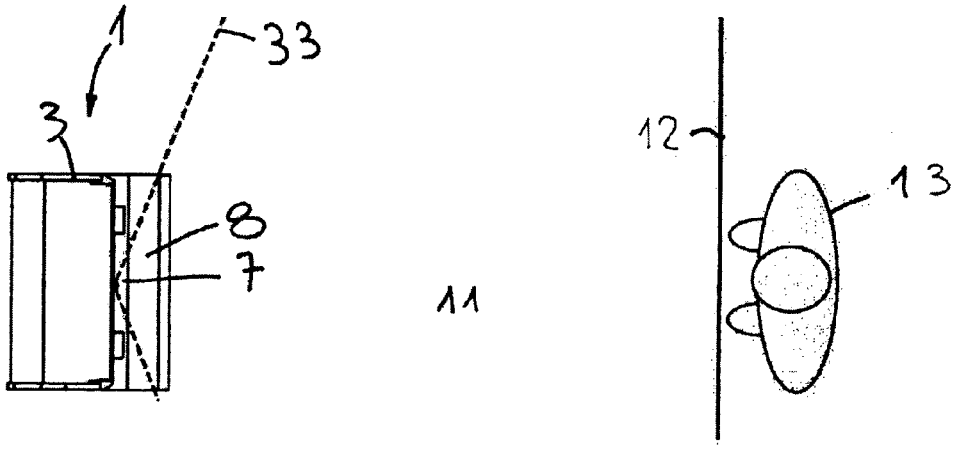
FIG. 2 is a top plan view of the machine and the area of play of FIG. 1.
Figure 3:
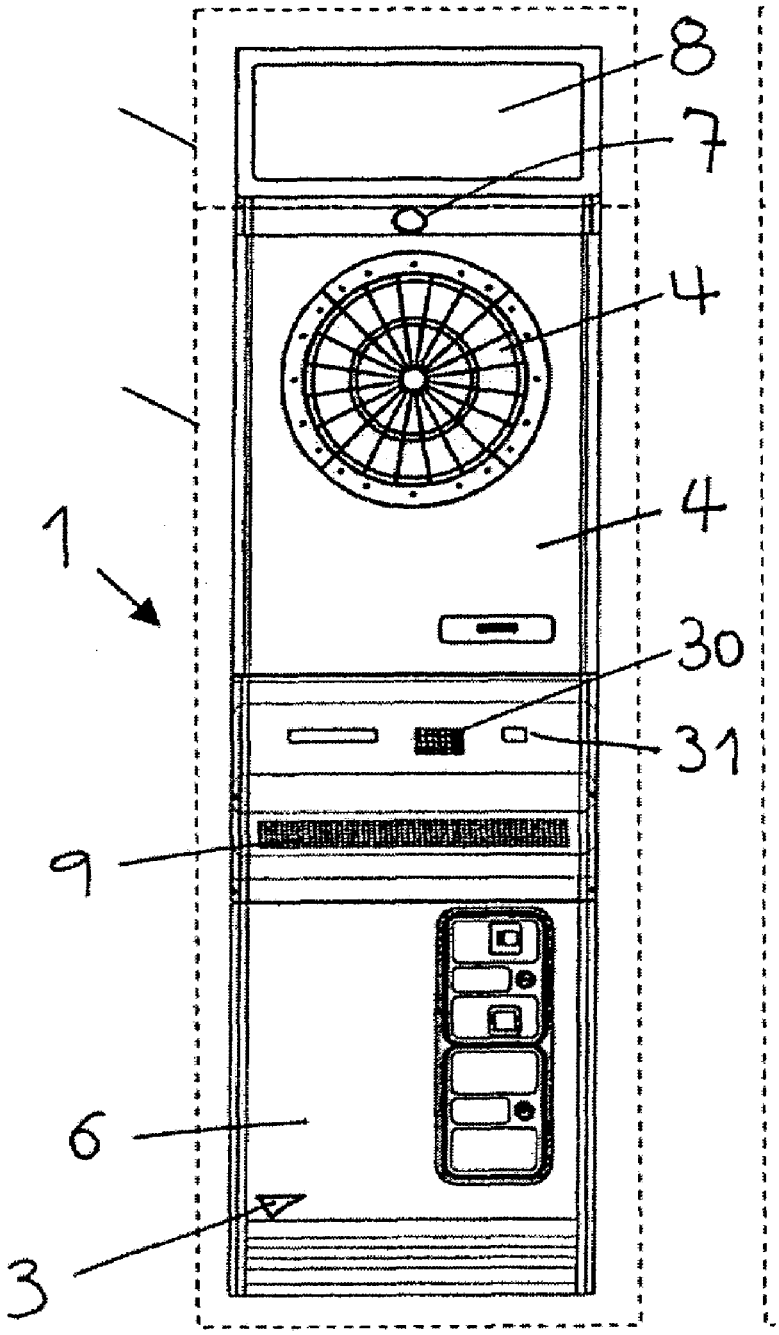
FIG. 3 illustrates a front elevational view of the machine of FIG. 1.

Through the drawings, the same numerical references indicate similar or corresponding elements or components.

Hereunder, a particular embodiment applicable to electronic amusement machines and darts games will be described, although everything stated here is also applicable, mutatis mutandis, to other types of amusement machines.

In this embodiment, the remote monitoring or refereeing system for amusement machines of the present invention is based on a plurality of amusement machines, specifically darts machines 1, equipped with play components with means to capture data of the full sequence of the play and on the results of the players at the machines (e.g., by detecting the impact and its place of impact on the dartboard) and means for transmitting the data captured in the machines to a network.

The darts machine 1 comprises a structure or housing 3, a dartboard 4, an interface panel 5 to enter data with a keyboard 30 and a microphone 31, and a panel 6 for a coin slot or other analogous payment elements. The darts machine 1 also comprises a digital video camera 7, a monitor 8 and a visible light emitter 9.

The monitor 8 can be any known type, in particular TFT, and its screen is preferably positioned in the upper part of the unit, protruding with respect to the front principal plane of the machine 1 with a certain gradient with respect to the vertical plane, which means the player 13 can better view the images transmitted.

The digital video camera 7 is equipped with filters, reflective elements and electronic equipment, and can simultaneously capture images from different sources and with varied, changing lighting. The camera 7 may have any suitable field of view appropriate for the conditions of the game. For example, dashed line 33 indicates one possible field of view.

The visible light emitted by the emitter 9 is preferably laser light and describes a luminous beam 10 which traces a throw line 12 on the floor 11, which marks the minimum regulatory distance of the position of the player 13 who is throwing the dart 14.

Figure 4:
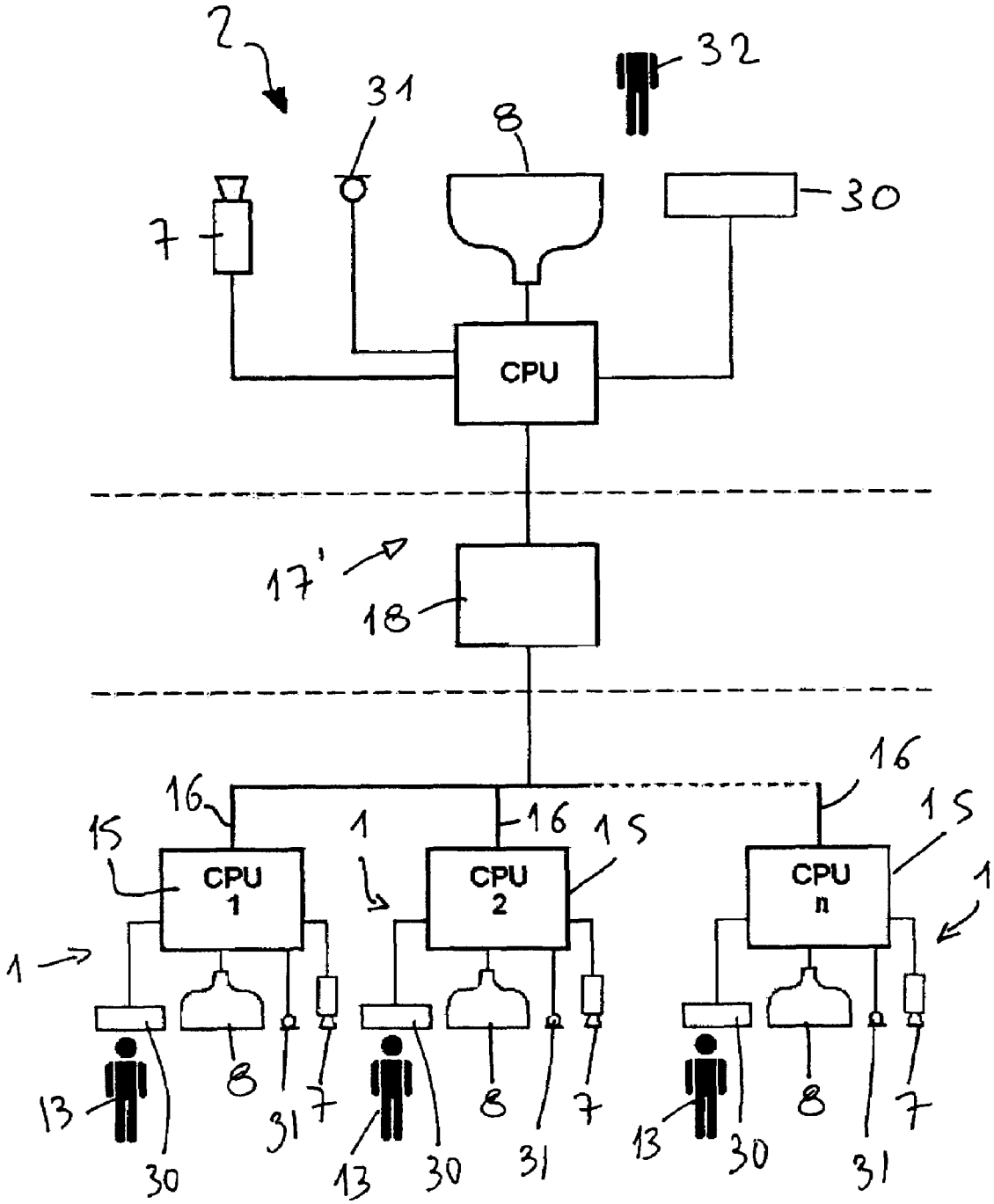
FIG. 4 illustrates a block diagram example for the remote refereeing system in a local network.

Each machine 1 of the system consists of a processor based device, e.g., CPU 15, wherein the multimedia data of the game is stored, and an output line 16 to communications network 17, 17'. The network may consist of a WAN, e.g., the Internet 17 (FIG. 5) or a LAN 17' (FIG. 4) or other network (e.g., wireless, cellular, satellite, etc. (not shown)).

The digital video camera 7 captures the motion image of the traced line 12 and an image recognition system in the CPU 15 detects if the player 13 crosses the line 12.

If it is a LAN 17', the machine will be connected to this network via a general purpose application server 18. If it is a WAN 17, the connection can be made through an Internet Service Provider (ISP) 28, the machines being connected through a local network Hub 20 and a Proxy PC 21, or through a ADSL router 22, or a modem 23.

Figure 5:
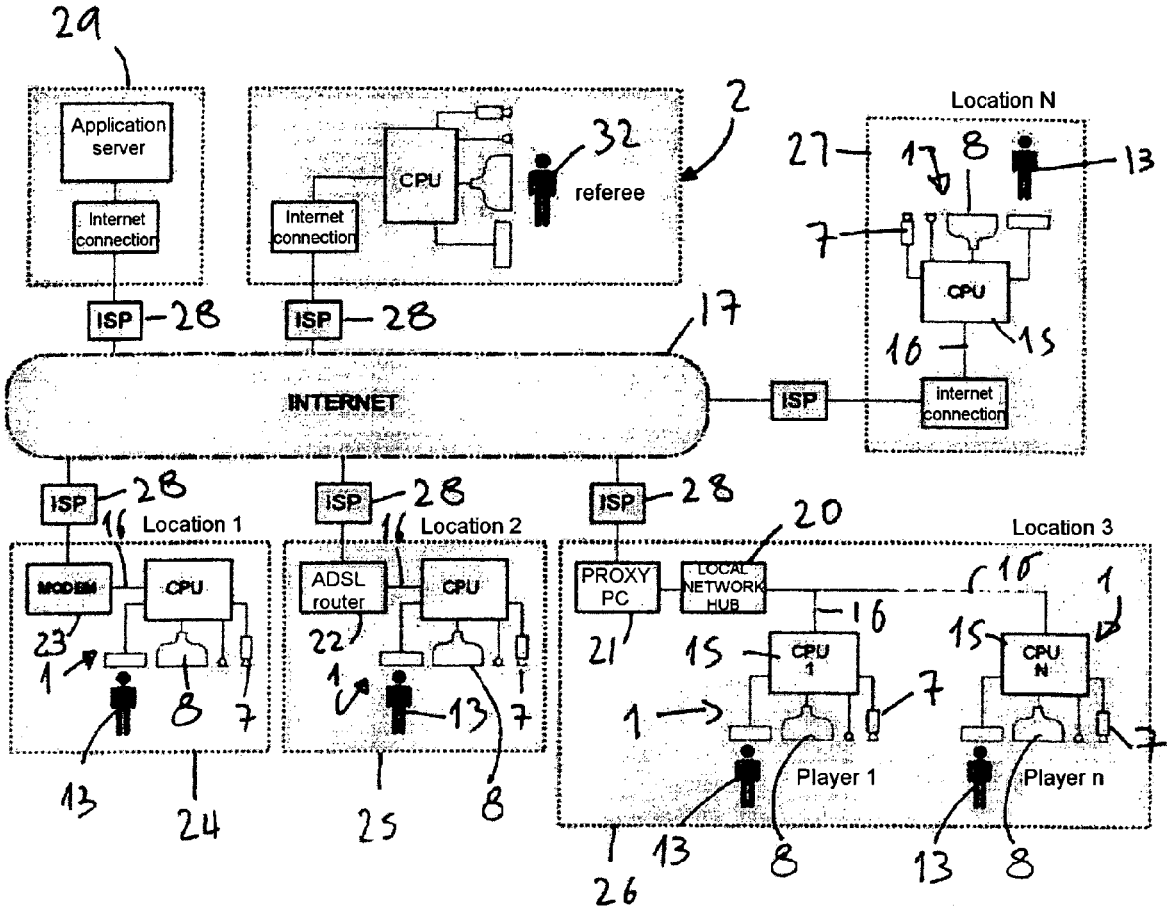
FIG. 5 illustrates a block diagram example for a remote refereeing system via a network such as the Internet.

In FIG. 5 we see that the network 17 is the Internet, different remote locations or games rooms 24, 25, 26, 27 can be connected to the network through different devices.

The system comprises at least one monitoring or refereeing center 2 for the data located in the network of arrays of the machines 1, likewise being possibly connected to the network through an ISP 28, for instant or delayed refereeing. The system works with at least an application server, likewise connecting to the network 17.

Each darts machine 1 and monitoring or refereeing center 2 are equipped with communication components or camera interface 7, monitor 8, keyboard 30 and microphone 31. The monitoring or refereeing centers 2 are also equipped with analogous communication components.

The monitoring or refereeing centers 2 can therefore monitor the state of development of the games in the machines 1 from the multimedia data located in the network 17, 17'.

The refereeing method according to some embodiments of the invention is as follows. For each machine 1 of an array of machines on the network 17, 17', if the player 13 complies with certain conditions of play, during the play, the capturing means of the machine 1 capture the development of the play and the video camera 7 records the image of the area of play and of the player 13, throughout the entire development of play.

The results and image data are immediately transmitted or stored in the machine computer system 15, and when they are called up by the monitoring or refereeing centers 2, the results and image data are recovered from the network 17, 17', stored and viewed by a referee 32 located in a center 2.

The referee 32 decides if the games selected have been played without infringing the rules of play, and the results of the portions of play and the winning player data are transmitted via the communication channel to the network 17, 17' and to the corresponding machines 1 according to the refereed competition. In the present example, a darts competition, the winning player(s) and the winning player data are displayed on the machines 1.

To decide on the results of the winning games, the referee 32 will make the validation based on the image data transmitted to the monitoring or refereeing center 2.

Optionally, a player can send a multimedia signal to the referee from a machine 1 to the monitoring or refereeing center 2, indicating an objection to the referee's decision, using the keyboard 30 and the microphone 31 to contact the referee 32 in real time or leave a message of objection. Based on this multimedia signal, the referee 32 decides, instantly or with time delay, on a final ruling on this objection, which he communicates to the network.

According to the invention, the refereeing of the results and winning portions of play is done immediately or with time delay. In this way, players in different locations can participate in a game when they desire and the referee can validate the results. For example, a player in Europe can participate at 10:00 a.m. in a game and a player in the USA, 8 hours later, and the referee give the result at 10:00 a.m. USA time.

Although it is foreseen that the referee is a human operator 32, the invention covers the possibility that the referee is an automatic or computer aided control.

The abovementioned merely illustrates the principles of the invention, Consequently, it will be appreciated that those skilled in the art can design different arrangements which, although they have not been explicitly shown or described herein, likewise incorporate the principles of the invention and are within its spirit and scope. In this sense, depending on the characteristics of the game, the data capturing means will adopt different forms. For example, in the case of billiards or snooker games, the video camera 7 can focus on the whole game table and sensors determine the hole in which the ball enters and the number of caroms.

What is claimed is:

1. A remote monitoring or refereeing system for one or more dart machines comprising:

one or more dart machines, each of the one or more dart machines comprising:

play components and means to capture multimedia information relating to conduct of play and performance of players using the one or more dart machines;

at least one camera to capture the conduct of play; and means for transmitting the multimedia and captured conduct of play information, and at least one refereeing center to receive multimedia and captured conduct of play information, to determine whether at least one of the players complies with at least one condition of play, either nearly instantaneously or with a time delay, and to transmit data including the determination as to whether at least one of the players complies with at least one condition of play to the one or more dart machines.

2. The system of claim 1 wherein each of the one or more dart machines further comprises:

at least one microphone and at least one speaker for audio communication, and wherein the means for transmitting further comprises a processor to process the multimedia information and the data captured.

3. The system according to claim 1, wherein each of the dart machines further comprise a means for providing a game boundary.

4. The system according to claim 3, wherein each of the dart machines further comprise:

an image recognition system to detect if conditions related to the game boundary are satisfied based on the captured conduct of play information.

5. The system according to claim 3, wherein the means for providing a game boundary is a laser.

6. The system according to claim 1, wherein the at least one refereeing center comprises: one or more monitors to enable monitoring of the games being conducted on the one or more dart machines.

7. The system according to claim 1, wherein the one or more dart machines further comprise a monitor to display the multimedia information and data and additional information from the one or more dart machines, wherein the additional information comprises direct or prerecorded images, text, or computer generated media.

8. The system according to claim 7, wherein a screen of the monitor is positioned in an upper part of the one or more dart machines, protruding with respect to a front principal plane of the one or more dart machines with a certain gradient with respect to a vertical plane.

9. The system according to claim 1, wherein the play components comprise one or more darts and a dart board.

10. A remote monitoring or refereeing method for dart machines, to be used in a system comprising:

a plurality of dart machines communicating over a network, each of the plurality of dart machines comprising: play components, means for capturing data on performance of the players at the machines and image capturing means;

means for transmitting the data captured from the dart machines to the communication network; and one or more refereeing centers for evaluating the data transmitted over the network and to enable refereeing of play substantially instantaneously or with a time delay;

the method comprising:

capturing, if the player complies with certain conditions of play during the game play, a result of a portion of play and an image of the area of play and of the player;

transmitting the result and the image to the one or more refereeing centers to be evaluated by a referee;

enabling a decision by the referee as to whether the portion of play has been performed without infringing a rule of play;

transmitting the decision via the network to corresponding dart machines according to a competition refereed; and displaying the decision on the corresponding dart machines according to the competition refereed.

11. The method, according to claim 10, wherein performance of players is refereed in real time.

12. The method according to claim 10, wherein the decision by a referee occurs in real time in a competition between two players who are in different locations.

13. The method according to claim 10, wherein the decision by a referee occurs with a time delay.

14. The method according to claim 10, wherein the decision by a referee is based on the result and the image transmitted to the one or more refereeing centers.

15. The method according to claim 10, wherein a player, may transmit a signal indicating an objection to a certain portion of play, either the player's own play or another player's play, to the one or more refereeing centers, and the player's are able to communicate using visual and verbal means, and wherein the referee makes a final ruling on objection to the certain portion of play.

16. The method according to claim 15, wherein the final ruling updates is transmitted to and displayed on the corresponding amusement machines.

17. The method according to claim 15, wherein the player transmits the signal in real-time.

18. The method according to claim 15, wherein the player transmits the signal after the indicating an objection.

19. The method according to claim 10, wherein the referee is a human operator assisted by electronic devices.

* * * * *